United States Patent [19]

Rimland

[11] Patent Number: 4,796,940

[45] Date of Patent: Jan. 10, 1989

[54] DISPOSABLE HAND GRIP FOR USE WITH PLASTIC BAG LOOP HANDLES

[76] Inventor: Bernard Rimland, 4182 Adams Ave., San Diego, Calif. 92116

[21] Appl. No.: 95,305

[22] Filed: Sep. 11, 1987

Related U.S. Application Data

[63] Continuation-in-part of Ser. No. 22,924, Feb. 26, 1987, abandoned.

[51] Int. Cl.[4] ..... A45F 5/10; B65D 33/06

[52] U.S. Cl. ..... 294/171

[58] Field of Search ..... 294/137, 141–143, 294/149, 153, 156, 165, 167, 170, 171; 16/110 R, 114 R, 114 B; 24/16 PB, 17 R, 17 A, 17 B, 17 AP, 30.5 P, 30.5 S; 220/94 R, 96; 229/52 A; 383/7, 13, 15, 24, 25, 29

[56] References Cited

U.S. PATENT DOCUMENTS

| | | | |
|---|---|---|---|
| 1,468,848 | 9/1923 | Wear | 294/171 |
| 1,691,467 | 11/1928 | Carver | 294/170 |
| 2,215,116 | 9/1940 | Crary | 294/171 |
| 2,671,486 | 3/1954 | Shaw | 150/1.7 |
| 3,197,830 | 8/1965 | Hoadley | 24/16 PB |
| 3,315,324 | 4/1967 | Ward | 24/16 PB X |
| 3,318,354 | 5/1967 | Borisof | 24/16 PB X |
| 3,512,701 | 5/1970 | Kamins et al. | 229/54 |
| 3,894,300 | 7/1975 | Shively | 4/185 |
| 3,912,140 | 10/1975 | Franges | 294/171 X |
| 4,112,541 | 9/1978 | Tetradis | 294/153 X |
| 4,570,368 | 2/1986 | Stover | 24/16 PB X |

FOREIGN PATENT DOCUMENTS

| | | | |
|---|---|---|---|
| 3347410 | 7/1985 | Fed. Rep. of Germany | 294/171 |
| 1473525 | 3/1967 | France | 24/17 AP |
| 2132882 | 7/1984 | United Kingdom | 294/171 |
| 2135179 | 8/1984 | United Kingdom | 294/171 |

*Primary Examiner*—Johnny D. Cherry

*Attorney, Agent, or Firm*—Browdy & Neimark

[57] ABSTRACT

An attachable and detachable hand-grip, primarily useful in conjunction with plastic bag loop handles, having a generally flexible plastic rectangular planar configuration, includes end edges and side edges, the hand-grip being bendable to a U-shape configuration along a central axis running between the side edges. The bent portions are locked together by suitable fastening elements.

7 Claims, 1 Drawing Sheet

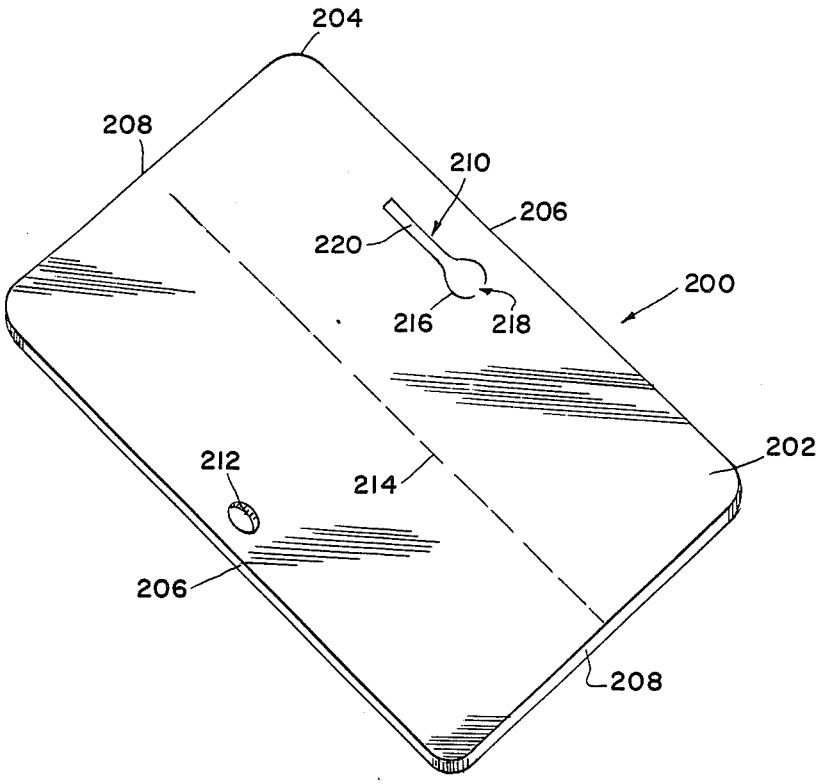
204
208
210
206
220
200
216
218
202
212
214
206
208

DISPOSABLE HAND GRIP FOR USE WITH PLASTIC BAG LOOP HANDLES

FIELD OF THE INVENTION

This is a CIP of parent co-pending application Ser. No. 22,924, filed Feb. 26, 1987, now abandoned, the contents which are incorporated herein by reference.

The present invention relates to an improved attachable and detachable throw-away hand-grip for carrying packages, more particularly an attachable hand-grip for use in conjunction with plastic bag loop handles and the like.

BACKGROUND OF THE INVENTION

During the past few years, supermarkets and other merchandisers have been increasingly utilizing plastic bags for packaging consumer products because of lower costs to the merchandiser. Many of these plastic bags include integrally formed loop handles which permit a user to carry the bag and its contents with ease and reliability by simply gripping the handles with one hand, as opposed to carrying the bag with an arm as is necessary with conventionally used handle-free kraft paper shopping bags. However, while these plastic bags may facilitate a reliable means for transporting goods, the bag loop handles have a tendency to bite into the customer's fingers causing discomfort, particularly when the bag must be carried over great distances and/or when the bag contents are excessively heavy. The same problem exists with old style paper shopping bags provided with handles.

Further, the plastic bags tend to collapse when placed on the floor, auto seat, or other surface, with the result that the contents frequently spill out.

Several attempts have been suggested to overcome these above discussed problems by utilizing hand grips of the attachable or removable type, which when applied to the plastic bag or other loop handles allows a user to grip the handles free from the discomfort usually associated with grabbing bare loop handles. Additionally, the hand-grips may maintain the bag in a closed position, especially when the bag is not being carried or when the bag is in a collapsed position on a floor or other surface.

Among the many various hand grips for use in conjunction with loop handles of carrying receptacles and plastic bags, there may be mentioned the U.S. Pat. No. 3,912,140 to Franges, which discloses a somewhat rigid hand-grip having a generally planar rectangular body including a centrally located widthwise preformed rounded region, and fastening means located on the opposing long sides of the body portions for securing the grip about rope loop handles. The preformed rounded region, when assembled to the rope loops, provides a rounded, non-sharp bottom carrying edge or surface. Due to their rounded edges or grip surface, these grips do not nest when packaged and therefore require excessive space during shipping to the merchandiser and storage in bulk before use. Furthermore, the hand-grip includes sharp lengthwise edges which may have a tendency to tear into the handle loops, thus breaking the loops and is that the bulk of these hand-grips require considerable material for their manufacture, which adds to their cost in production and shipping.

The U S. Pat. Nos. 2,717,411 to Taipale; 3,800,361 to Stauffer; 3,913,172 to Richards et al; 4,004,722 to Olivier; and 4,590,640 to Enersen all show hand-grips for use with loop handles of carrying receptacles, all of which generally provide a comfortable grip for users, as well as maintaining the receptacles in a closed position. However, these above-mentioned patents disclose relatively complex hand-grips which are generally expensive to manufacture. The hand-grips are also generally of the reusable type (non-disposable) and, when assembled to the loop handles, do not include fastening means to insure that the grips will not prematurely dislodge from the loops, particularly when the bag or receptacle is resting. The U.S. Pat. No. 3,072,944 to Mitchell discloses a cardboard type of hand-grip for use with loop handles, which is also not provided with fastening means; also see Carver U.S. Pat. No. 1,691,467.

The Herbert et al U.S. Pat. No. 2,519,186 shows a preformed, rigid and expensive shopping bag carrier. A similar device is shown in UK published patent application No. 2,135,179 A in the name of Machado et al. Neither of these devices has a closure fastener, and both are made of heavy material and are relatively difficult to form. These devices depend on the bulk and rigidity of the material from which they are made. Because they are preformed, at least to some extent, they are not only costly and difficult to manufacture, but are also very backward to store in large quantities as they are not nestible and take up much space in storage. Because of the large bulk of material, the shape and difficulty of manufacture, and the inability to store efficiently, these devices are far too expensive to be throw-away items.

Of particular interest is DE OS No. 33 47 410 A1 in the name of Muller. This patent depicts a hand grip which is preformed, and thus rather bulky to store, quite apart from the problem of pre-forming same. It is mentioned in the English language abstract that the device can have a "touch and close" fastening device, but no fastener of any type is illustrated.

Closure fasteners, of course, are well known per se. Attention is invited to Hubner U.S. Pat. No. 3,050,578; Laguerre U.S. Pat. No. 3,255,51; Pool U.S. Pat. No. 3,468,050; Merser U.S. Pat. No. 3,516,124; and Cisek et al U.S. Pat. No. 4,477,950. Clayton U.S. Pat. No. 3,633,247 discloses a strap closure; see especially FIG. 5. Stover U.S. Pat. No. 4,570,368 illustrates a thin card or label 10 formed of a stiff material such as cardstock for attachment to plants, and including a locking means.

There are now close to 30 billion plastic handled shopping bags sold in the U.S.A. each year, and the number is going up. These plastic handled shopping bags are apparently in great demand and greatly favored by merchandisers. However, the problems with these bags as outlined above are very real, and the need exists for a suitable hand grip to prevent the aforementioned problems, but such hand grip must be extremely inexpensive.

No throw-away hand-grip for use with loop handles of carrying receptacles has previously been available made from semi-rigid or flexible plastic materials which is very inexpensive to manufacture, includes quick and reliable detachable fastening means for attaching the grip to loop handles, and is provided with edges which will not tear into the loop handles. There is, moreover, a need for such an attachable throw-away hand-grip which can be delivered to and stored by merchandisers in great numbers without taking up substantial storage space. Furthermore, there is a need for a flexible attachable and detachable throw-away hand-grip for keeping the loop handles, when assembled to the hand grip, from movement within the grip, as well as for providing a smooth, rounded surface to permit a user to carry the receptacle with a single hand without discomfort.

PARENT APPLICATION

Parent application Ser. No. 22,924, now abandoned provides a construction which obviates many of the deficiencies of the prior art. However, the embodiments there disclosed are not as simple in construction as desirable.

SUMMARY OF THE INVENTION

Accordingly, it is an object of the present invention to overcome deficiencies of the prior art, such as directed above.

It is a further object of the present invention to provide purchasers with a more comfortable way to carry purchased merchandise in bags with integral handles.

It is another object to provide an improved throw-away hand-grip for use with loop handles of carrying receptacles, bags as well as for use with the bails of buckets and similar containers, and cartons, parcels, or boxes tied with cord.

It is yet another object of the present invention to provide an attachable hand-grip which can be made very inexpensively and transported and stored inexpensively.

It is still another object of the present invention to provide an attachable hand-grip having improved integrally formed fastening means for securing the hand-grip to loop handles, bucket bails, and carton-binding cord.

It is yet a further object of the present invention to provide an improved attachable and detachable throw-away hand-grip.

It is still a further object of the present invention to provide an attachable hand-grip for use with loop handles which will not damage the loop handles when assembled or fastened thereto.

It is another object of the present invention to provide an attachable hand-grip including a comfortable hand-contacting surface when assembled to and used with loop or other handles.

It is another object of the present invention to provide an attachable throw-away hand-grip which can be reused if desired.

It is still another object of the present invention to provide an attachable hand-grip for use with loop handle carrying receptacles which permits users a comfortable grip when fastened to loop handles, and maintains the receptacle in a closed position when resting, particularly receptacles of the plastic bag type.

It is still yet another object to provide a more simplified construction of an attachable and detachable hand-grip compared with the embodiments illustrated in parent application Ser. No. 22,924.

Still other objects, features and attendant advantages of the present invention will become apparent to those skilled in the art from a reading of the following detailed description of embodiments constructed in accordance therewith, taken in conjunction with the accompanying drawings, wherein:

BRIEF DESCRPTION OF THE DRAWING

The sole FIGURE is a perspective view of an attachable and detachable hand-grip according to the present invention.

DESCRIPTION OF PREFERRED EMBODIMENTS

The sole FIGURE shows an attachable and detachable hand-grip 200 according to the present invention which is formed of a flexible and generally planar plastic sheet 202 which may be die cut from a larger sheet of plastic which may be extruded. The sheet 202 has a smooth undersurface and may be formed of any flexible plastic such as plasticized polyvinyl chloride or Mylar (polyethylene terephthalate) or even an elastomeric material, but preferably it is formed of a polyolefin, e.g. polyethylene or most preferably polypropylene. The thickness should be sufficiently great so that the sheet 202 is not limp, but it should not be so great that it cannot be bent 180° without difficulty. In practice, a thickness of about 20–40 mils (0.020–0.40 inches) is satisfactory; depending on the particular plastic used, thicknesses substantially below 20 mils may be too limp, and thicknesses above 40 mils may make the product either too rigid or merely result in the provision of excess plastic which increases the cost without any benefit.

The sheet 202 is of desirably rectangular configuration as shown, preferably with rounded corners 204 located between opposite end edges 206 and opposite side edges 208. It will be understood that the dimensions of the side and end edges may vary considerably, but that preferably the side edges are from 3 to 4 inches long and the end edges about 4–5 inches long.

An important feature of the attachable hand-grip 200 is the provision of a fastening means for fastening the two end edges 206 adjacent one another during usage. In the preferred embodiment, the fastening means consists of a male element 210 partially die cut through the body of the sheet 202, and a mating female opening 212 spaced opposite therefrom, and described in greater detail below. In use, loop handles or the like are placed across the width of the hand-grip 200 between the two side edges 208 generally along the length of the center portion thereof as schematically illustrated by the line 214. Then the two ends 206 are bent or folded toward each other to create a generally U-shape in cross-section and in end view, with the handles to be supported being held at the bottom of the U. The fastening means 210, 212 are then locked as described below.

Because of the relatively soft and flexible nature of the material used and the relative thickness of the sheet 202, the side edges 208 are sufficiently soft to constitute cushioning means for cushioning handles of the carrying bags or the like so as to prevent the cutting or tearing of such handles. However, it is possible during die cutting of the sheet 202 from a larger sheet to press or emboss the side edges 208 along the central portion defined by the ends of the line 214 so as to reduce the thickness even more and thereby provide even a softer cushioning means.

The preferred fastening means according to the illustrated embodiment is particularly simple, inexpensive and effective. It includes an elongated tail 220 and an enlarged circular portion 216 of the male member 210, these being die cut from and through the thickness of the sheet 202, except for a connecting portion 218 on the end of the circular section 216 spaced opposite the elongated tail 220. The female portion 212 is merely a circular hole having a diameter less than the diameter of the circular portion 216. For example, the maximum diameter of the hole 212 is about 3/16 inch, and the maximum diameter of the circular portion 216 is desirably about 5/16 inch. Desirably, the connecting section 218 should be spaced directly opposite the opening 212.

In use, the elongated tail 220 is threaded through the opening 212 and when the enlarged circular portion 216 meets the opening 212 further force is applied to pull the enlarged circular portion 216 through the hole 212. This is possible because the material is sufficiently flexible so that the circular portion will deform and go through the hole 212. However, because of memory in the material, once the circular portion 216 has passed through the hole 212, it will return to its flat configuration thereby preventing unlocking.

It will be obvious to those skilled in the art that various other changes and modifications may be made without departing from the scope of the invention and the invention is not to be considered limited to what is shown in the drawings and described in the specification.

What is claimed is:

1. An attachable hand grip for encircling handles of plastic carrying bags or the like, consisting of a generally fat body portion formed of substantially uniform plastic sheet material of about 20–40 mils thickness sufficiently flexible to be bent into a generally U-shaped configuration to provide an inside surface and an outside surface, said body portion being generally rectangular with a pair of opposite side edges and a pair of opposite end edges;

said side edges being sufficiently soft to constitute cushioning means for cushioning handles of carrying bags or the like so as to prevent the cutting or tearing of such handles; and fastening means unitary with said body portion for fastening opposite ends of said body portion together near said end edges when said body portion has been folded to a generally U-shape, said fastening means comprising a male member die cut generally adjacent one end edge and an interengagable female member adjacent another end edge extending entirely through said body portion.

2. An attachable hand grip in accordance with claim 1 die-stamped from a larger sheet of flexible plastic material.

3. An attachable hand grip according to claim 1 die-stamped from a polyolefin plastic sheet

4. An attachable hand grip for encircling handles of plastic carrying bags or the like, comprising a generally flat body portion formed of thin plastic sheet material sufficiently flexible to be bent into a generally U-shaped configuration to provide an inside surface and an outside surface, said body portion being generally rectangular with a pair of opposite side edges and a pair of opposite end edges;

said side edges being sufficiently soft to constitute cushioning means for cushioning handles of carrying bags or the like so as to prevent the cutting or tearing of such handles; and fastening means unitary with said body portion and located generally adjacent said end edges for fastening opposite ends of said body portion together near said and edges when said body portion has been folded to a generally U-shaped, said fastening means comprising a female member and a male member including an elongated tail section and a circular male portion at one end thereof, said elongated tail section and circular male portion being die cut from and through said body portion with a connecting section of said circular male portion being located generally opposite said elongated tail section, and said female member comprising a generally circular opening spaced opposite said connecting section of said male member, the diameter of said female opening being less than the diameter of said circular male portion.

5. An attachable hand grip in accordance with claim 4 wherein said thin plastic sheet material has a thickness of about 20–40 mils.

6. An attachable hand grip in accordance with claim 4 die-stamped from a larger sheet of flexible plastic material.

7. An attachable hand grip according to claim 4 die-stamped from a polyolefin plastic of thickness about 20–40 mils.

* * * * *